US011540643B2

(12) United States Patent
Wildeman et al.

(10) Patent No.: US 11,540,643 B2
(45) Date of Patent: Jan. 3, 2023

(54) MATTRESS WITH FLAME BARRIER CAP AND RELATED METHOD

(71) Applicant: TIETEX INTERNATIONAL, LTD., Spartanburg, SC (US)

(72) Inventors: Martin Wildeman, Spartanburg, SC (US); Nicholas James Brownless, Spartanburg, SC (US); Robert Wade Wallace, Greenville (SC)

(73) Assignee: TIETEX INTERNATIONAL LTD, Spartanburg, SC (US)

( * ) Notice: Subject to any disclaimer, the term of this patent is extended or adjusted under 35 U.S.C. 154(b) by 0 days.

(21) Appl. No.: 17/194,244

(22) Filed: Mar. 6, 2021

(65) Prior Publication Data

US 2022/0279935 A1 Sep. 8, 2022

(51) Int. Cl.
*A47C 27/14* (2006.01)
*A47C 31/00* (2006.01)

(52) U.S. Cl.
CPC ..... *A47C 27/14* (2013.01); *A47C 31/001* (2013.01)

(58) Field of Classification Search
CPC ..... A47C 27/00; A47C 27/14; A47C 31/00; A47C 31/001
See application file for complete search history.

(56) References Cited

U.S. PATENT DOCUMENTS

| | | | | |
|---|---|---|---|---|
| 10,617,225 | B1 * | 4/2020 | Wildeman | A47C 27/008 |
| 2012/0102657 | A1 | 3/2012 | Wildeman | |
| 2018/0360227 | A1 * | 12/2018 | Martin | D04H 3/011 |
| 2019/0284737 | A1 * | 9/2019 | Martin | D04B 21/165 |

FOREIGN PATENT DOCUMENTS

WO 2020214772 A1 10/2020

* cited by examiner

*Primary Examiner* — Fredrick C Conley
(74) *Attorney, Agent, or Firm* — J.M. Robertson, LLC

(57) ABSTRACT

A mattress including a stretchable flame-retardant textile cap incorporating a top panel of flame retardant material operatively connected to a stitch-bonded flame retardant textile skirting with machine direction stretch and recovery properties disposed over a resilient mattress core to provided flame barrier protection to the mattress core.

20 Claims, 7 Drawing Sheets

MATTRESS WITH FLAME BARRIER CAP AND RELATED METHOD

TECHNICAL FIELD

This application is directed to mattresses, and more particularly to stretchable flame barrier constructions adapted for at least partially covering a mattress core of foam or other resilient material.

BACKGROUND OF THE DISCLOSURE

It is known to provide mattresses with stretchable flame barrier fabric positioned between a resilient mattress core and a decorative textile covering. In one approach, prior flame barrier panels have been formed from non-woven materials of fleece construction incorporating inherently flame-retardant fiber constituents either alone or blended with other fibrous constituents. By way of example only, and not limitation, such prior flame barrier materials have been formed from flame resistant (i.e. "FR") materials such as: (i) flame retardant rayon alone; (ii) flame retardant rayon blended with para-aramid fibers; (iii) flame retardant rayon blended with para-aramid fibers and polyester; and (iv) other fibers or blends having flame retardant properties including modacrylic, wool, meta-aramid and the like.

While the prior known flame barrier materials provide good flame blocking and insulation character, they typically have limited capacity to stretch and recover. This limitation may be particularly problematic with respect to mattresses which incorporate core materials such as latex foam, polyurethane foam and the like that undergo substantial localized deformation during use.

One approach used to address the lack of stretch and recovery in flame barrier panel materials has been to encapsulate the mattress foam core in a knit sock structure formed from flame retardant yarns ("FR Socks"). FR Socks are typically circular knitted tubular fabrics formed from materials such as covered fiberglass yarn, bare fiberglass, modacrylic, FR rayon or other kinds of fire-resistant yarns. During the mattress assembly process, the FR Sock is installed by pulling the tubular fabric over the entire mattress core. The open ends of the FR Sock tube are then closed with a sewing machine using a fire-resistant sewing thread such as Kevlar thread or an equivalent. After the FR Sock is in place around the core, the outer cover of the mattress is then installed over the "socked" mattress core. The outer cover is usually made up of a decorative ticking fabric on the top surface and edge borders of the mattress. In a typical exemplary construction, a filler cloth is used on the bottom side of the sewn cover assembly with a zipper fastener sewn into the filler cloth to conveniently close the cover over the socked mattress core. Of course, other cover arrangements may likewise be used.

One advantage of FR socks is that unlike most other FR solutions, they have excellent stretch and adequate recovery properties such that they do not impede the cushioning and comfort properties supplied by the mattress core. This lack of cushioning impediment may be particularly important at the top surface of a mattress where foam panels may be present to enhance user comfort.

Although FR socks may provide satisfactory performance when correctly installed, they are also very easy to overstretch and distort during installation and can sometimes cause tight areas on the mattress thereby restricting local foam deformation. Another significant disadvantage of FR Socks is that they are cumbersome and time consuming to install during mattress assembly, so incurring unnecessary high labor costs to the mattress assembler. In addition, the use of fiberglass yarns creates a potential for skin irritation for factory workers who handle the FR socks and potentially for users who sleep on the mattresses.

FR caps have been used as an alternative to FR socks. Prior FR caps are typically formed from tubular FR sock material that is slit open to create an open width fabric. A "cap" or "fitted sheet" is then made from this material using a fire-resistant sewing thread. A deficiency of current FR caps is that the slit circular knit material is extremely difficult to handle during cutting and sewing. Specifically, such material tends to distort and curl very easily. A further disadvantage of FR caps formed from slit FR socks is that an elasticated tape or equivalent must be sewn to the bottom open side of the cap or fitted sheet to secure the cap onto the mattress core. The complexity and cost of converting FR sock material into FR caps has greatly limited the use of FR caps in the mattress industry. In addition, although the attached elastic band on these prior caps allows the gathering of the FR sock fabric around the mattress core, the resulting cap does not truly conform to the mattress core and, thus, it is not truly "form fitting". This form fitting can be improved with the undersizing of the pattern of said caps for the mattresses, but this serves to overstretch and distort areas in the cap, especially at the corners and edges of the mattress so leading to aforementioned stretch restriction and compromised FR protection.

Due to the deficiencies in the known art, there is a continuing need for an improved FR covering for a resilient mattress core that will conform better to the mattress core and not impede the cushioning and comfort properties supplied by the mattress core.

SUMMARY OF THE DISCLOSURE

In accordance with one exemplary aspect, the present disclosure provides advantages and alternatives over the prior art by providing a true form fitting stretchable flame-retardant textile cap incorporating a top panel with operatively connected stitch-bonded skirting with machine direction stretch and recovery properties for disposition between a resilient mattress core and outer cover. An FR textile cap consistent with the present disclosure offers the benefits of prior FR socks and FR caps but with significantly enhanced ease of use and without the need to use fiberglass in large quantities.

In accordance with one exemplary aspect, the present disclosure provides a fabric construction for use in forming the skirting of an FR cap incorporating a nonwoven fleece containing FR fibers stitched with substantially parallel rows of elastomeric yarns such as covered spandex or the like running in the fabric length dimension to impart machine direction (MD) stretch and recovery. The fleece may be formed from materials such as FR silica rayon, FR treated rayon, para-aramid, modacrylic, wool, and the like including blends of such materials with one another and/or with fibers such as polyester, cotton or the like.

The resulting FR fabric construction does not exhibit curl and becomes dimensionally stable in the machine direction upon substantially full extension of the elastomeric stitching in the fabric. Thus, the fabric extended in the MD can be easily handled on a sewing machine without concern for curling or distortion as is common with other stretchy FR fabrics. These properties permit lengths of stitch-bonded FR fabrics consistent with the present disclosure to be applied as a stretchable skirting around the perimeter of a top panel overlying the top of the mattress core. Furthermore, it is not necessary to sew an elasticated tape or the like into the open perimeter edge of the stretchable skirting material since the elastomeric yarns in the fabric construction perform this function.

As will be appreciated, although the FR fabrics forming the cap skirting have strength and dimensional stability in the cross-machine direction (CD), they can nonetheless stretch with the attached top panel as necessary due to the elastomeric stitching yarns in the MD. That is, the MD of the skirting runs substantially parallel to the entire perimeter of the top panel. As a result, the present disclosure provides a greatly simplified FR mattress cap and related method of manufacture with lower complexity and lower cost of handing and sewing.

Furthermore, the ability to apply juxtaposed patterning of elastomeric yarns within the skirting fabric, whether through the use of different yarn deniers, concentration of yarns and spacing between elastomeric yarns within the fabric, all running substantially parallel to the perimeter of the top panel, may be used to create a stretch and recovery "power gradient" within the skirt. In this manner, using a greater concentration of elastomeric yarns within the skirt, where the skirt folds under the mattress core allows for better conformability and form fitting of the cap to the mattress core, without causing deformation of such.

In accordance with one exemplary aspect, the skirting fabric may include a gripping power zone extending inboard from a distal free edge of the skirting fabric adapted to grip the underside of a mattress being covered. The gripping power zone may incorporate a plurality of stitch lines with multiple ends of elastomeric yarn per needle in a stitching pattern with long float lengths skipping one or more perforations between stitches. The skirting fabric may also include an attachment zone disposed along a proximal edge of the skirting fabric incorporating one or more stitch lines with multiple ends of elastomeric yarn per needle in a stitching pattern with long float lengths skipping one or more perforations between stitches.

Other exemplary aspects of the disclosure will become apparent upon review of the following detailed description of preferred embodiments and practices.

BRIEF DESCRIPTION OF THE DRAWINGS

The accompanying drawings, which are incorporated in, and which constitute a part of this specification, illustrate exemplary constructions and procedures in accordance with the present disclosure and, together with the general description of the disclosure given above and the detailed description set forth below, serve to explain the principles of the disclosure wherein.

While constructions consistent with the present disclosure have been illustrated and generally described above and will hereinafter be described in connection with certain potentially preferred embodiments and practices, it is to be understood that in no event is the disclosure limited to such illustrated and described embodiments and practices. On the contrary, it is intended that the present disclosure shall extend to all alternatives and modifications as may embrace the general principles of this disclosure within the full and true spirit and scope thereof. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DESCRIPTION

Figure 1:
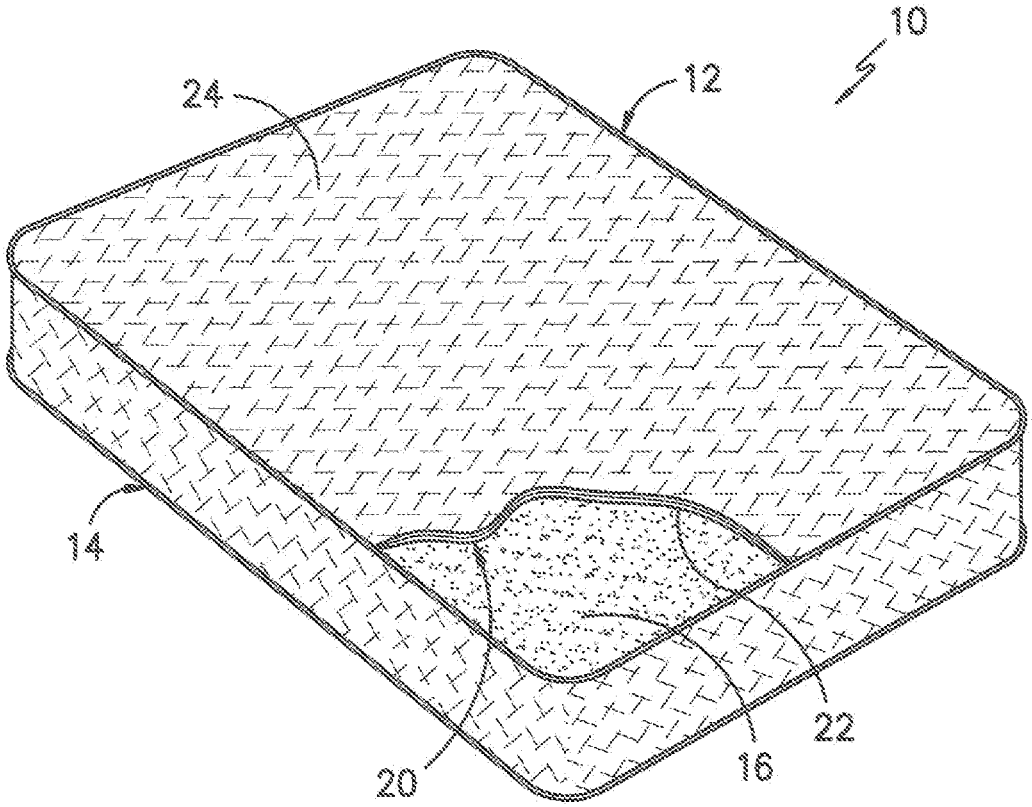
FIG. 1 is a partial cut-away view of an exemplary mattress construction consistent with the present disclosure.

Reference will now be made to the drawings, wherein to the extent possible like reference numerals are utilized to designate corresponding components throughout the various views. In FIG. 1 there is illustrated a mattress 10 having an upper face 12 and sides 14. In the illustrated exemplary construction, the mattress 10 generally includes a core 16 of foam alone or in combination with supporting springs (not shown). By way of example only, and not limitation, the foam may be a visco-elastic polyurethane foam, latex foam, or the like having a density of about 1-12 pounds per cubic foot and more preferably about 3 to 7 pounds per cubic foot although other resilient foams and densities may likewise be utilized. The foam core 16 may have a continuous stiffness throughout the thickness of the mattress 12 or may be layered with different materials and varying stiffness levels at different positions in the thickness dimension.

Figure 2:
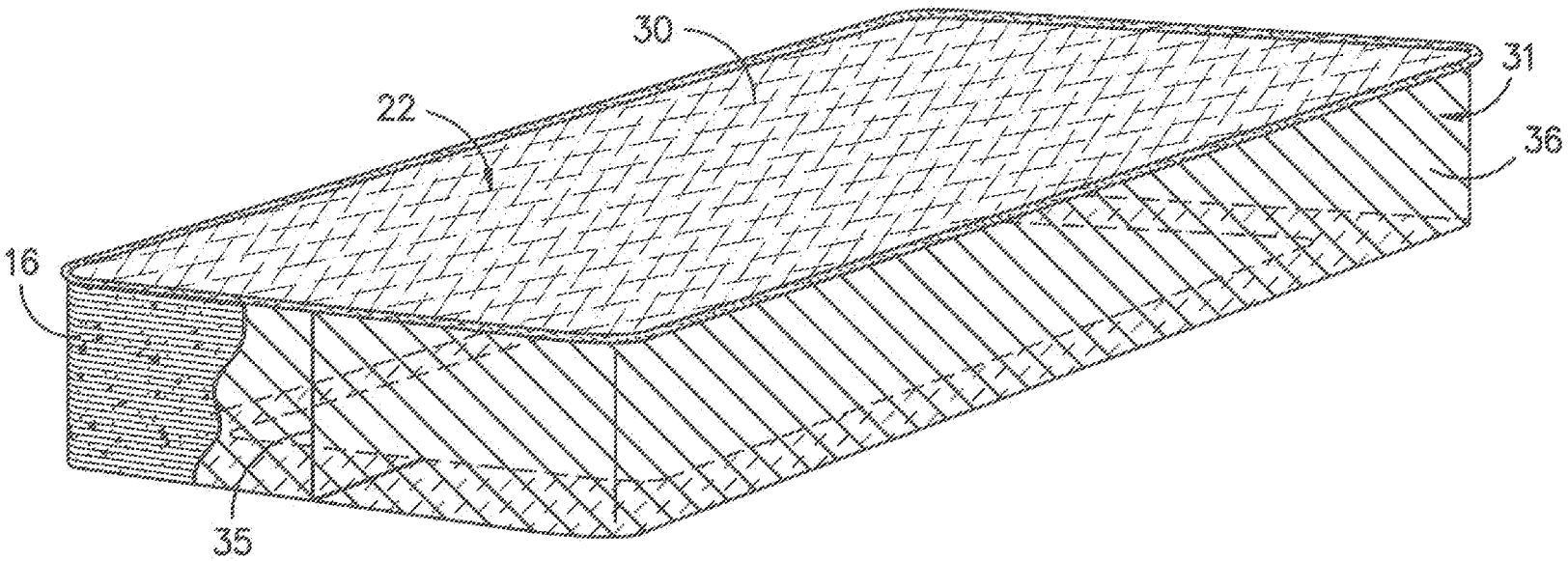
FIG. 2 is a schematic view of an exemplary covered mattress core illustrating a cap with a top panel and attached skirting of FR fabric with MD stretch and recovery consistent with the present disclosure defining side panels wherein the attached skirting includes distal edge zones with enhanced high stretch and recovery power at the underside of the core.

In the illustrated arrangement, the core 16 is at least partially covered with an overlay structure 20 including a stretchable cap 22 disposed in form-fitting relation around the core 16 to cover at least the top and sides of the core 16. As will be described further hereinafter, a portion of the stretchable cap 22 may also be disposed across a portion of the underside of core 16 (FIG. 2). The overlay structure may also include a decorative outer covering 24 such as a circular knit ticking fabric or the like covering the stretchable cap 22 at the tops and sides of the mattress. Alternatively, the stretchable cap 22 may define the outer covering such that no additional covering layer is required.

In the illustrated exemplary construction, the stretchable cap 22 is preferably free from any physical connection to covering layer 24 if one is used. However, the stretchable cap 22 and any outer covering 24 may be connected if desired. Such connection may be at intermediate discreet positions or may be along a substantially continuous interface. By way of example only, such connection may be made by quilting, adhesive bonding or other techniques as may be known to those of skill in the art.

Referring to FIG. 2, in the exemplary construction the stretchable cap 22 includes a top panel 30 adapted to overlay the top of core 16 defining a substantially horizontal support surface during use. The stretchable cap 22 also includes stitch-bonded skirting 31 operatively connected around the perimeter of the top panel 30. Skirting 31 is adapted to cover the vertical sides of core 16 and optionally extend at least partially across the underside of core 16. As will be appreciated, while the stretchable cap 22 may be in direct contact with both core 16 and any ticking or other decorative outer covering 24, it is likewise contemplated that one or more intermediate layers may be interposed between the stretchable cap and the core 16 and/or between the stretchable cap 22 and any outer covering 24. Moreover, as noted previously, outer covering 24 may be eliminated if desired. Both the top panel 30 and the skirting 31 are flame retardant such that the stretchable cap provides a flame barrier over the core 16.

The top panel 30 preferably has some degree of recoverable stretch capacity (as defined herein) in at least one direction although such recoverable stretch capacity is not necessarily essential. The top panel 30 preferably has a recoverable stretch capacity in at least one direction in the range of at least 5% or greater and more preferably about 10% to 80% or higher. In accordance with one potentially preferred construction, the top panel 30 may be is characterized by substantially omnidirectional stretch and recovery properties with recoverably stretch capacity of at least 5% or greater in all directions and more preferably about 10% to 80% or higher in all directions. By way of example only, and not limitation, the top panel 30 may be a knitted fabric such as a circular knit, warp knit, flatbed knit or the like incorporating FR yarns. By way of example only, the fabrics used in current FR socks may be used to form the top panel 30 if desired. The top panel 30 may also be a stitch-bonded flame barrier panel incorporating flame barrier fibers and having omnidirectional stretch and recovery as illustrated and described in U.S. Pat. No. 10,617,225 (incorporated by reference). However, any other flame barrier material with suitable omnidirectional stretch and recovery character may likewise be utilized.

In stretchable cap 22, the skirting 31 is preferably a stitch-bonded FR fabric incorporating a fleece stitching substrate containing FR fibers. By way of example only, one exemplary stitching substrate for skirting 31 may be a substantially 100% flame retardant silica rayon fiber fleece. However, other materials may be used if desired. By way of example only, such other materials may include rayon fibers treated with FR ("flame retardant") chemicals, para-aramid, meta-aramid, modacrylic, wool and other fibers with FR properties. Materials such as FR treated or coated polyester or cotton and blends of any of the foregoing may also be used if desired. All such materials are flame retardant fibers. One contemplated blend which may be particularly desirable is flame retardant silica rayon fiber blended with some percentage of para-aramid and/or meta-aramid fiber. One exemplary blended fibrous substrate material may be a blend of about 95% flame retardant silica rayon fiber and about 5% Para-aramid fiber. Higher percentages of Para-aramid fiber up to about 25% or more may be used if desired. It is also contemplated that in some applications a fibrous base of a blend of FR fibers with non-FR fibers including polyester, polyamide or bicomponents thereof or a fibrous base of substantially all polyester fiber may be used either with or without FR treatment if desired.

During formation of the skirting 31, the fleece stitching substrate is stitched with elastomeric stitching yarns such as covered spandex or the like to impart machine direction (MD) stretch and recovery. The term elastomeric stitching yarns will be understood to mean stitching yarns with the ability to stretch at least 50%, and more preferably at least 100% prior to breakage and which will return to within 10% of their initial length within one hour following 50% stretching under standard atmospheric conditions. That is, the length after stretching to 50%, holding the stretched condition for not more than 5 seconds, and release will be not more than 110% of the length before stretching when measured after 1 hour at ambient conditions and will more preferably be in the range of 100% to 105% of the length before stretching.

In accordance with one exemplary practice, the fibers in the fleece stitching substrate used to form the skirting 31 may be oriented predominantly in the cross-machine direction ("CD"). That is, the direction across the machine and substantially perpendicular to the travel direction during stitching. In this regard, the fleece stitching substrate used to form the skirting 31 is preferably formed from a plurality of staple length fibers having an average length in the range of about 1 to 5 inches. These staple fibers may be carded and cross-lapped with an optional subsequent needling step to form a fleece structure wherein the majority of the fibers are oriented substantially in the CD. In such a carded and cross-lapped fleece structure the fibers predominantly form an angle within plus or minus 30 degrees of a line parallel to the CD. That is, the majority of the fibers will be substantially aligned within 30 degrees to the CD. Since a fiber in a nonwoven construction does not typically extend in a straight line, the orientation of a fiber relative to a reference line may be defined by reference to a line connecting the fiber ends as described in U.S. Pat. No. 9,090,801 to Siebert et al. which is hereby incorporated by reference in its entirety.

Maintaining fiber orientation predominately in the CD reduces the recoverable stretch capacity in the CD after stitching. In this regard, the term "recoverable stretch capacity" will be understood to be the percent elongation of a sample under tension which is followed by recovery to within 3% of the starting length after 1 minute under ambient conditions In testing for recoverable stretch capacity, a modified version of test method ASTM-D3107 (incorporated by reference) may be used. This modified test procedure measures recovery following predefined stretch in the following manner:

1. A three-inch-wide test sample is obtained with a length dimension aligned with the direction being tested;
2. Mark and measure benchmarks on the sample spaced 127 mm±5 mm apart;
3. Clamp one end of the test sample in hanging relation such that the other end hangs freely, and the benchmarks are at least 2 inches away from the clamp;
4. Apply a manual tensile force to the free end until the spacing between the benchmarks increases by the desired percentage and then immediately release (within no more than 3 seconds);
5. Place the sample in an unstressed flat condition and remeasure the distance between the benchmarks at 1 minute.

This testing procedure is herein referred to as the "Tietex Stretch and Recovery Evaluation."

The skirting 31 in the stretchable cap may be characterized by substantial recoverable stretch capacity in the MD of at least 25% such that a sample stretched in the MD by 25% (or less) in accordance with the above procedure will return to within 3% of its initial length within 1 minute after tension is removed. More preferably, the skirting 31 may be characterized by recoverable stretch capacity in the MD of at least 50% such that a sample stretched in the MD by 50% (or less) in accordance with the above procedure will return to within 3% of its initial length within 1 minute after tension is removed. Most preferably, the skirting 31 in the stretchable cap may be characterized by recoverable stretch capacity in the MD of at least 90% such that a sample stretched in the MD by 90% (or less) in accordance with the above procedure will return to within 3% of its initial length within 1 minute after tension is removed.

The skirting 31 may be characterized by substantially less recoverable stretch capacity in the CD than in the MD. That is, the recoverable stretch capacity in the skirting is not balanced. In accordance with one exemplary practice, the recoverable stretch capacity of the skirting 31 in the CD is not more than 65% of the recoverable stretch capacity of the skirting in the MD and is more preferably not more than 10% to 55% of the recoverable stretch capacity of the skirting in the MD.

In practice, the skirting 31 may be cut as a one-piece strip in the machine direction immediately after the stitch-bonding process and is then sewn along one of its longitudinal edges in a substantially fully extended state around the entire perimeter of the top panel 30 using FR sewing thread such as Kevlar or the like. In this construction, the top panel 30 provides FR protection to the top surface of the mattress and is sewn in a relaxed, non-extended state to the fully extended skirting 31. As shown in FIG. 2, a final, single vertical seam 35 using FR sewing thread is then used to attach the leading edge of the skirting 31 to its trailing edge to complete the stretchable cap 22. Of course, such a seam is not limited to a single sewn seam as illustrated and can be an overlocked seam or any other connecting seam that allows suitable closure of the "skirting loop" sewn around the top FR panel.

As will be appreciated, when the stretchable cap 22 is installed on the core 16, the skirting 31 formed from FR fabric with MD stretch will seek to pull back to its original non-extended length and will thereby "self-secure" or grip to the mattress core and provide FR protection for the vertical side surfaces of the mattress. The resulting stretchable cap 22 thus provides FR protection for both the upper surface and the 4 vertical surfaces of the mattress core. Furthermore, the fleece substrate of a stitch-bonded FR fabric with MD stretch used in the skirting 31 will conform to the mattress core and provide substantially continuous fiber coverage across underlying surfaces. That is, the stretched fabric does not form openings to create uncovered areas. Such continuous fiber coverage enhances FR protection to the underlying mattress core.

The resulting stretchable cap 22 also provides partial FR protection for a zone of about 3 inches to 10 inches or greater inboard from the underside perimeter of the mattress core. In this regard, it is contemplated that so called "Filler Cloth" (not shown) used on the outer ticking cover or attached to the free edge of skirting 31 may provide further FR protection to the bottom side of the mattress in inboard zones not covered by the skirting 31.

In construction of the stretchable cap 22, the FR fabric with MD stretch that forms the skirting 31 may be slit in the machine direction on the stitch-bonding machine into multiple usable widths of approximately 16 inches each. However, other fabric widths can be customized for different mattress thicknesses. The fabric may then be wound onto rolls at the stitch-bonding machine under tension to be in an extended condition. These rolls typically require no further finishing and are deemed to be in a usable state for direct use as a skirting material for converting into stretchable caps 20 for mattress fire protection.

By way of example only, and not limitation, in accordance with one exemplary and potentially preferred practice, a stitch-bonded FR fabric with MD stretch that forms the skirting 31 may utilize a stitching substrate of 100% FR Rayon fiber fleece with a mass per unit area of about 120 gsm (grams per square meter). The fabric may be stitched at a needle density of 7 needles per inch and a stitch density in the machine direction of between 5 courses per inch to 18 courses per inch (preferably about 10 courses per inch)

Figure 3:
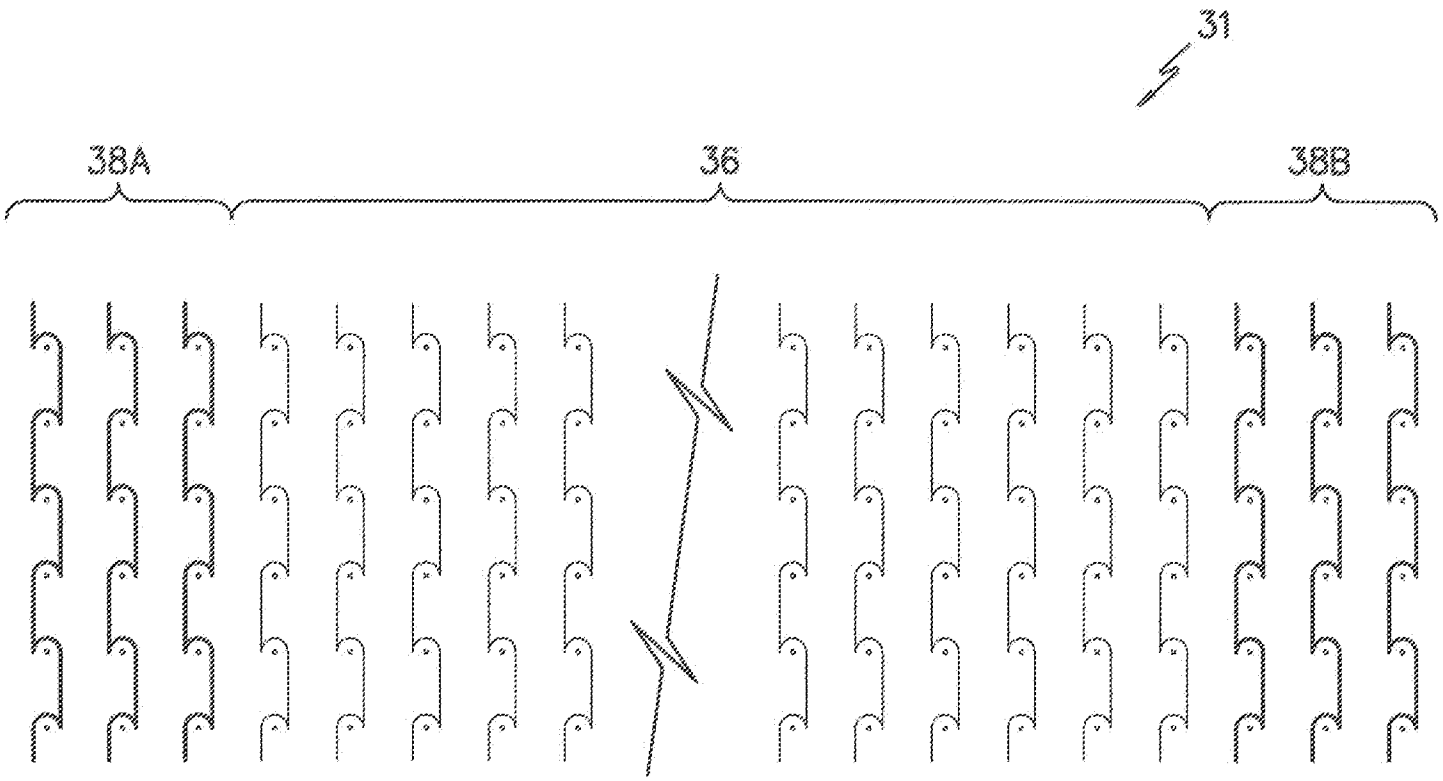
FIG. 3 is a schematic view illustrating an exemplary stitching pattern for a first embodiment of a stitch-bonded FR fabric with MD stretch and recovery for use in forming the skirt of a flame barrier mattress core cap consistent with the present disclosure.

Referring now to FIG. 3, in a first exemplary construction, the main body 36 of the FR fabric forming the skirting 31 may be stitched with a 70 denier spandex yarn with a 75 denier/36 filaments textured polyester yarn cover with one end per needle. That is, each needle engages one stitching yarn. In this exemplary embodiment, the longitudinal edges 38A, 38B of the panels are both stitched with 5 ends per needle (represented as bold lines) of 140 denier spandex in 3 adjacent needles. The presence of the high concentration of heavier spandex stitching yarns at the distal edge 38B provides a higher power of stretch and recovery on the edge of the skirting positioned under the core 16 (FIG. 2) in order to secure the stretchable cap 22 in place after installation. The presence of the heavier spandex stitching at the proximal edge 38A is also beneficial in permitting strips to be wound uniformly without distortion in roll winding. Alternatively, a heavier, non-elastic stitching yarn, an applied laminate, or other structures to increase thickness could be used at the proximal edge 38A for the same purpose.

It is also contemplated that the same denier elastomeric stitching yarns may be used throughout the FR fabric forming the skirting 31 but with higher concentrations of those stitching yarns at one or both edges to promote more powerful stretch recovery in those zones. Such a construction eliminates the need to use multiple yarn deniers and thereby permits the skirting to be formed as a single-bar fabric rather than as a two-bar fabric. By way of example only and not limitation, in accordance with one exemplary construction, the 70 denier covered spandex yarn described above may be used throughout the fabric as the sole stitching yarn, but with 5-6 (or more) ends per needle at three or more needles adjacent to one or both edges. Of course, yarns with linear densities other than 70 denier may likewise be used in such a construction. The resulting fabric will exhibit a degree of enhanced stretch recovery at the selected edge zones thereby aiding in form-fitting around the mattress core.

Figure 4:
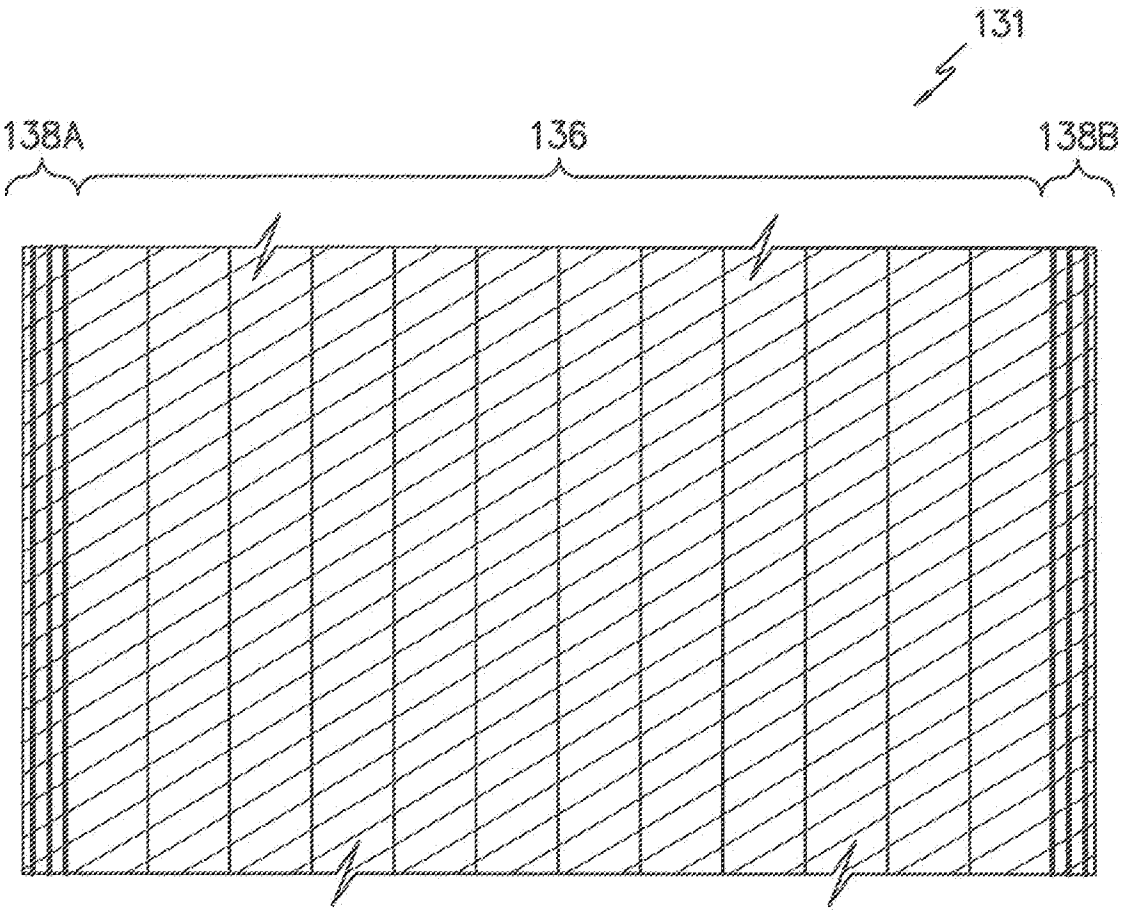
FIG. 4 is a schematic view of an alternative embodiment of an FR fabric with MD stretch and recovery for use in forming the skirt of a flame barrier mattress core cap consistent with the present disclosure with enhanced elastic power across the fabric to aid in hugging the mattress core.

Referring now to FIG. 4, in a second exemplary embodiment for the FR fabric forming a skirting 131, a greater population of heavier spandex stitching yarns may be distributed uniformly across the entire fabric interior width using chain stitches or other suitable patterns. By way of example only and not limitation, in one exemplary construction spandex yarns with a linear density of 140 denier may be stitched at 5 ends per needle approximately 1 inch apart within the fabric interior 136. Zones between the heavier spandex may be stitched at one end per needle using the 70 denier spandex previously described. Heavy spandex yarns are also concentrated at edge zones 138A, 138B at a spacing of about 0.25 inches apart. This exemplary embodiment provides even greater elastic power and security of the stretchable cap after it is installed on the mattress core.

Figure 5:
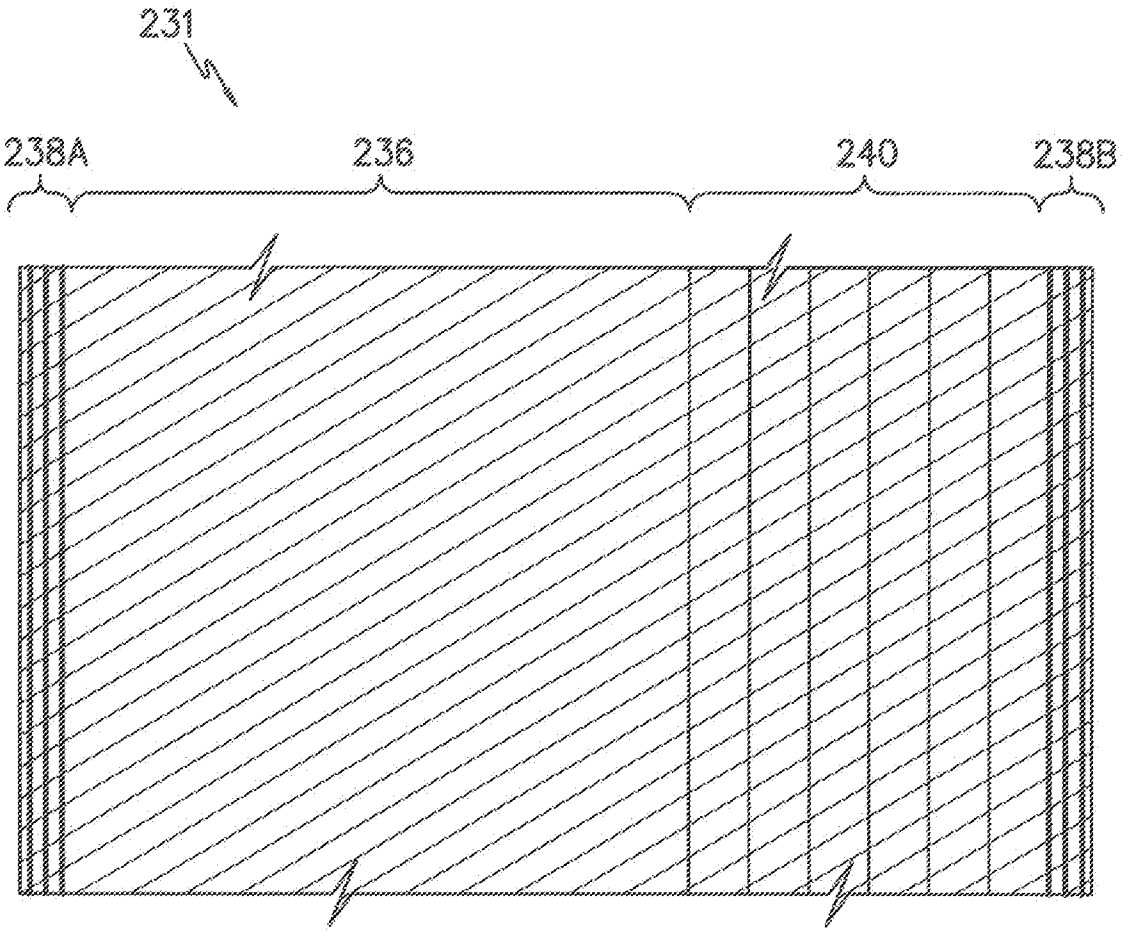
FIG. 5 is a schematic view of another embodiment of an FR fabric with MD stretch and recovery for use in forming the skirt of a flame barrier mattress core cap consistent with the present disclosure with zones of varying elastic power including an edge zone of enhanced elastic power for disposition under a mattress core and an adjacent interior zone having lesser elastic power for disposition across the vertical sides of the mattress core.

Referring now to FIG. 5, a third exemplary embodiment for the FR fabric forming the skirting 231 is illustrated. As illustrated, this exemplary embodiment provides a zoned construction wherein additional heavier spandex stitching yarns such as 140 denier spandex at about 5 ends per needle are stitched at about one inch apart selectively within a reinforced zone 240 of approximately 4-6 inches along the distal edge of skirting 31 which is pulled under the core. In this exemplary construction, Zones between the heavier spandex and within the main body 236 are stitched at one end per needle using the 70 denier spandex previously described. The concentration of higher denier spandex yarns below the mattress core provides additional elastic power and security of the stretchable cap 22 after it is installed.

The zoned construction illustrated in FIG. 5 provides a gradient of elastomeric power with the highest elastomeric power at the distal edge zone 238B underlying the mattress core and with gradually reduced elastomeric power in zones covering the sides and corners of the mattress core. The gradient in elastomeric power may facilitate good conformability of the skirting to the foam in all areas without exerting undue stress to distort the foam. In this regard, in a zoned construction as illustrated, the maximum contraction will be in the area underlying the foam without the need to correspondingly contract the areas overlying the sides, edges and corners. Thus, the skirt will conform not only to the sides of the foam but also the edges and the corners while still maintaining fiber coverage. Moreover, the enhanced contraction underneath the mattress core may aid in reducing pleating across curved edges and corners thereby facilitating more uniform coverage.

Figure 6:
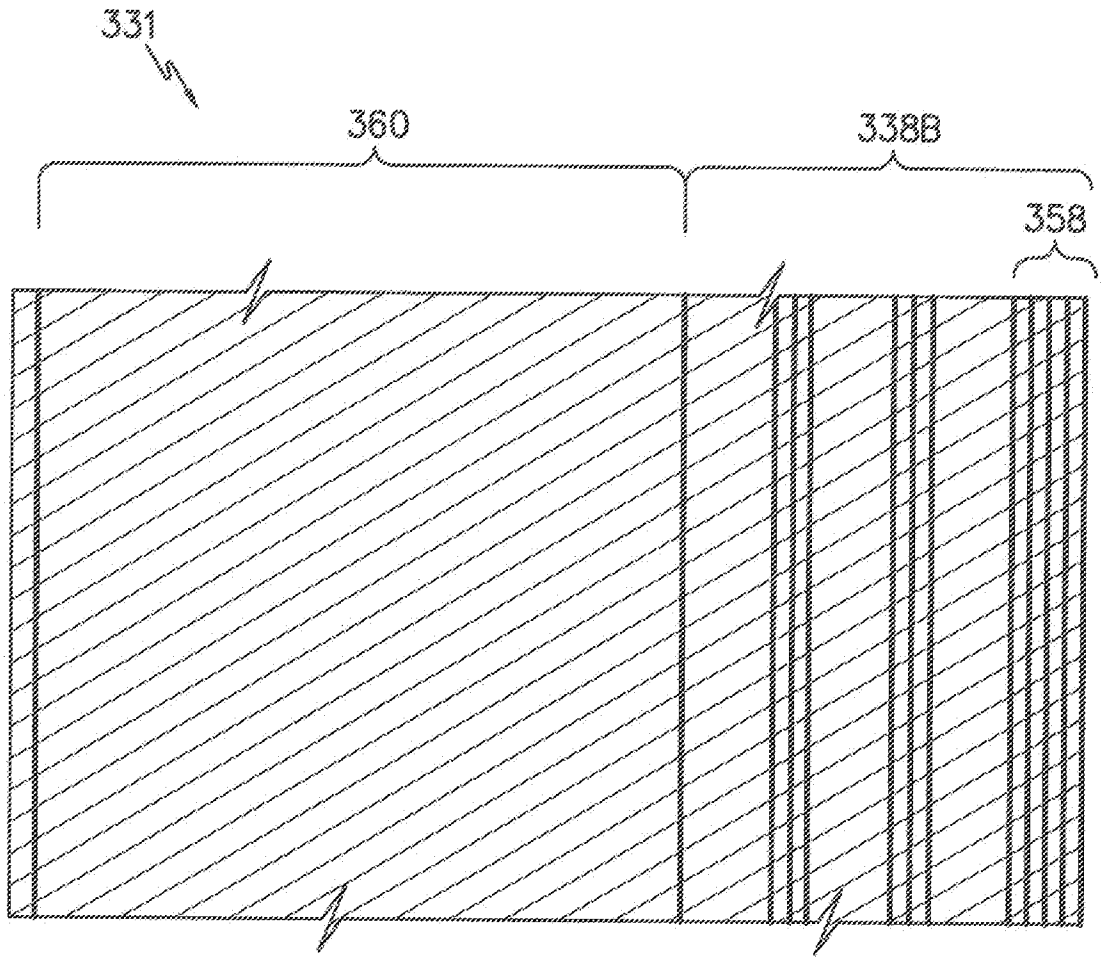
FIG. 6 is a schematic view showing an enhancement to the embodiment of FIG. 5 forming an FR fabric with MD stretch for use in forming the skirt of a flame barrier mattress core cap consistent with the present disclosure with increasing zones of varying elastic power including an edge zone of enhanced elastic power for disposition under a mattress core to allow for enhanced conformability and form fitting of the cap to the mattress core.

Referring now to FIG. 6, a fourth exemplary embodiment for the FR fabric forming skirting 331 is illustrated. As illustrated, this exemplary embodiment provides an enhanced zoned construction wherein additional heavier spandex stitching yarns such as 140 denier spandex are incorporated as in FIG. 5 but with a progressively increased number of needles within a power stretch distal edge zone 338B including a final heavy band 358 at the distal edge for final disposition under the mattress core. Such a construction allows good conformability of the cap on the sides of the mattress without distortion of the foam core and also allows for the skirting to lie flatter on the underside of the core facilitated by the powerful stretch recovery force within the heavy band 358 thereby allowing for better form fitting. By way of example only, and not limitation, the distance between bands of 140 denier yarn can be approximately 0.5 inches apart. This spacing may be increased or decreased to inversely increase or decrease the stretch recovery power gradient within the fabric skirt. In this configuration, a side covering zone 360 is positioned inboard of the power stretch distal edge zone 338B and will overlay the sides of the mattress core without substantially deforming the core.

Figure 7:
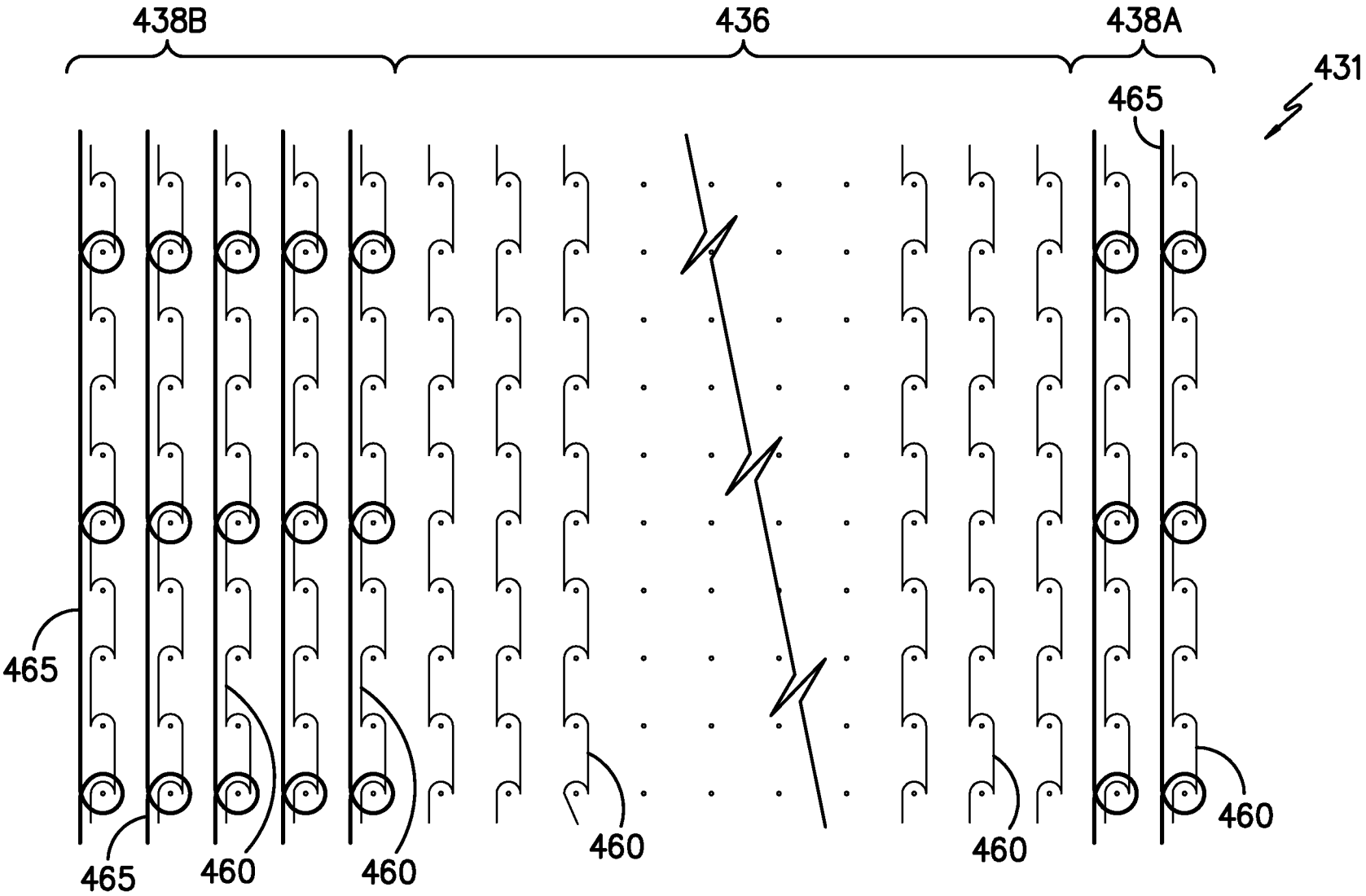
FIG. 7 is a schematic view of another embodiment of an FR fabric with MD stretch and recovery for use in forming the skirt of a flame barrier mattress core cap consistent with the present disclosure. The illustrated FR fabric includes zones of varying elastic power including a gripping power zone (438B) of enhanced elastic power for disposition along the distal edge of the skirt adapted for placement under a mattress core, an adjacent interior zone (436) having lesser elastic power adapted for disposition across the vertical sides of the mattress core and an attachment zone (438A) disposed along a proximal edge of the skirting fabric adapted for operative attachment to a top panel of the core cap.

Referring now to FIG. 7, another exemplary embodiment for the FR fabric forming skirting 431 is illustrated. As illustrated, this exemplary embodiment provides an enhanced zoned construction wherein additional heavier elastomeric stitching yarns such as 280 denier Spandex are incorporated in a plurality of stitch lines defining a gripping power zone 438B extending inboard from a distal free edge of the skirting fabric adapted to grip the underside of a mattress being covered.

In the embodiment illustrated in FIG. 7, the gripping power zone 438B may incorporate a plurality of stitch lines stitched using at least two different yarn systems. Specifically, the gripping power zone 438B may incorporate stitch lines with a relatively light-weight elastomeric yarn 460 in a chain stitch notation in combination with multiple ends per needle of heavier denier elastomeric yarn 465. By way of example only, the skirting 431 may be stitched across its entire surface with a relatively lightweight elastomeric yarn such as a 40 denier covered spandex yarn using a simple chain stitch with pattern notation of 0,1/1,0// threaded with one end per needle (i.e., one yarn per needle). However, other deniers and stitch variations can likewise be used if desired.

As illustrated, in the gripping power zone 438B the stitch lines may also incorporate multiple ends per needle of relatively high denier elastomeric yarn 465 in a stitching pattern with extended length floats skipping one or more perforations between stitches along the needle lines. The skirting fabric may also include an attachment zone 438A disposed along a proximal edge of the skirting fabric incorporating one or more stitch lines with multiple ends of relatively high denier elastomeric yarn 465 per needle in a stitching pattern with long float lengths skipping one or more perforations between stitches.

By way of example only and not limitation, the gripping power zone 438B and the attachment zone 438A may utilize spandex high denier elastomeric yarns 465 with a linear density of 140 to 1000 denier (more preferably 140 denier to 420 denier and most preferably 280 denier) threaded with 1 to 10 ends per needle (more preferably 2 to 6 ends per needle and most preferably 4 ends of per needle). The high denier elastomeric yarns 465 may be stitched with a repeating notation of 0,1/0,0/0,0/0,0// such that a stich is formed at every fourth needle perforation. As shown the lightweight yarn 460 is also stitched within the gripping power zone 438B and the attachment zone 438A using a chain stitch notation.

Of course, other stitching notations which provide extended float lengths may likewise be used for the high denier elastomeric yarns 465. In this regard, a float length between stiches in the range of about 0.24 inches to 1 inch and more preferably 0.35 inches to 0.6 inches may be desirable. However, longer or shorter float lengths may be used if desired.

The gripping power zone 438B may incorporate any suitable number of stitch lines incorporating relatively high denier elastomeric yarn 465 in a stitching pattern with long float lengths. By way of example only, a range of about 2 to 15 such stitch lines may be desirable. Likewise, attachment zone 438A may also incorporate any suitable number of such stitch lines incorporating relatively high denier elastomeric yarn 465 in a stitching pattern with long float lengths or may eliminate such stitch lines entirely if desired. By way of example, a range of about 2 to 15 such stitch lines in the attachment zone 438A may be desirable.

As will be noted, in each of the exemplary embodiments illustrated in FIGS. 4-7, relatively light-weight covered spandex yarns or the like (not shown) are preferably stitched throughout the fabric. All such lightweight yarns may be stitched in a chain stitch or other similar pattern. The polyester yarn cover of the light-weight spandex yarn aids in providing resistance to deknitting and unravelling of the chain stitches by entangling in itself. Thus, the FR fabric forming the skirting 31 may be made at a relatively low number of stitches per inch without concern for deknitting. Stitching the light-weight spandex at about 7 needles per inch also provides seam strength and CD dimensional stability to the resulting fabric. Further, the lightweight spandex contracts to a substantially similar degree as the heavier spandex stitching yarns and, thereby, provides a relatively smooth appearance to the fabric. This maintains a nicely tailored appearance to the stretchable cap when installed on the mattress core.

Regardless of the stitching pattern utilized, in accordance with one exemplary practice, the entire stretchable cap 22 may undergo steaming and drying at elevated temperature without applied tension after construction has been completed. In this regard, it has been found that the relaxed steaming of the stretchable cap 22 causes the FR rayon fiber content in the skirting to soften while also causing the elastomeric spandex stitching yarns in the skirting to contract dramatically in the machine direction. This combination of softened rayon and contracted spandex results in significantly enhanced MD recoverable stretch capacity in the skirting in the final cap which may exceed 100 percent or more. The contraction is substantially localized within the skirting with only about 0-5% shrinkage in the relatively stable top panel 30 with more balanced fiber orientation. Such heat treatment after formation permits the cap 22 to be adapted to a wider range of mattress sizes.

Incorporating relatively long float lengths in stitching high denier elastomeric yarn may be particularly beneficial in promoting stretch capacity. In this regard, the elastomeric yarn is permitted to shrink much more during steaming. Thus, the stretch capacity is greatly increased. By way of example, the resulting final stretch capacity of the skirting as described in relation to FIG. 7 be up to 210%. Moreover, it will be understood that the stitch patterning and materials described in relation to FIG. 7 wherein relatively higher denier elastomeric yarns are stitched with extended length float segments in combination with lower denier elastomeric yarns may likewise be used in any of the other described embodiments at perimeter zones or other areas where additional stretch power may be desirable.

In accordance with another exemplary practice, a percentage of bicomponent fiber having a lower melting point sheath surrounding a higher melting point core may be blended into the fiber forming the fleece used to produce the FR skirting. The percentage of bicomponent may be in the range of about 1% to 20% and will most preferably be about 10%. Activating the bicomponent fiber in a steaming and drying process may improve the dimensional stability of the skirting in the CD. Such improved dimensional stability may aid in avoiding visual puckers and thin areas after the cap is applied over the mattress core.

The use of the terms "a" and "an" and "the" and similar referents in the context of describing the disclosure (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate, and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A mattress comprising:

a resilient foam core; and a flame barrier cap disposed over the core, wherein the flame barrier cap comprises a top panel of flame resistant fabric disposed in overlying relation to a substantially planar upper surface of the core, the flame barrier cap further comprising a stitch-bonded flame resistant skirting disposed in overlying relation to sides of the core perpendicular to the upper surface, wherein the skirting comprises at least one length of stitch-bonded fabric including a first plurality of elastomeric stitching yarns disposed in stitched relation through a flame retardant fleece substrate in a plurality of substantially parallel adjacent stitch lines running in a machine direction of the stitch-bonded fabric, and wherein the skirting further comprises a gripping power zone extending inboard from a distal free edge of the skirting adapted to grip the underside of the core, the gripping power zone comprising the first plurality of elastomeric stitching yarns in combination with at least a second plurality of elastomeric stitching yarns and wherein the second plurality of elastomeric stitching yarns are stitched along common stitch lines with the first plurality of elastomeric stitching yarns, the second plurality of elastomeric stitching yarns being stitched in a pattern with elongated float segments skipping one or more needle perforations between stitches within the stitch lines.

2. The mattress as recited in claim 1, wherein the elongated float segments skip two to six needle perforations between stitches.

3. The mattress as recited in claim 1, wherein the elongated float segments have a length in the range of 0.24 to 1 inch.

4. The mattress as recited in claim 1, wherein the second plurality of elastomeric stitching yarns have a linear density greater than the first plurality of elastomeric stitching yarns.

5. The mattress as recited in claim 4, wherein one or more stitch lines within the gripping power zone each comprise a multiplicity of said second plurality of elastomeric stitching yarns.

6. The mattress as recited in claim 5, wherein one or more stitch lines within the gripping power zone each comprise in the range of 2-6 of said second plurality of elastomeric stitching yarns.

7. The mattress as recited in claim 6, wherein the fleece substrate comprises a plurality of carded and cross-lapped flame-resistant staple fibers.

8. The mattress as recited in claim 7, wherein at least a majority of the staple fibers are FR Rayon.

9. The mattress as recited in claim 7, wherein at least a majority of the staple fibers are oriented within plus or minus 30 degrees of a line running perpendicular to the machine direction.

10. A mattress comprising:

a resilient foam core; and a flame barrier cap disposed over the core, wherein the flame barrier cap comprises a top panel of flame resistant fabric disposed in overlying relation to a substantially planar upper surface of the core, the flame barrier cap further comprising a stitch-bonded flame resistant skirting disposed in overlying relation to sides of the core perpendicular to the upper surface, wherein the skirting comprises at least one length of stitch-bonded fabric including a first plurality of elastomeric stitching yarns disposed in stitched relation through a flame retardant fleece substrate in a plurality of substantially parallel adjacent stitch lines running in a machine direction of the stitch-bonded fabric, and wherein the skirting further comprises a gripping power zone extending inboard from a distal free edge of the skirting adapted to grip the underside of the core, the gripping power zone comprising the first plurality of elastomeric stitching yarns in a chain stitch pattern in combination with at least a second plurality of elastomeric stitching yarns having a linear density greater than the first plurality of elastomeric stitching yarns and wherein the second plurality of elastomeric stitching yarns are stitched along common stitch lines with the first plurality of elastomeric stitching yarns, the second plurality of elastomeric stitching yarns being stitched in a pattern with elongated float segments having a length in the range of 0.24 to 1 inch between stitches within the stitch lines.

11. The mattress as recited in claim 10, wherein the elongated float segments skip two to six needle perforations between stitches.

12. The mattress as recited in claim 10, wherein the elongated float segments have a length in the range of 0.24 to 0.6 inch.

13. The mattress as recited in claim 10, wherein the second plurality of elastomeric stitching yarns have a linear density in the range of 140 denier to 320 denier.

14. The mattress as recited in claim 13, wherein one or more stitch lines within the gripping power zone each comprise a multiplicity of said second plurality of elastomeric stitching yarns.

15. The mattress as recited in claim 14, wherein one or more stitch lines within the gripping power zone each comprise in the range of 2-6 of said second plurality of elastomeric stitching yarns.

16. The mattress as recited in claim 15, wherein the fleece substrate comprises a plurality of carded and cross-lapped flame-resistant staple fibers.

17. The mattress as recited in claim 16, wherein at least a majority of the staple fibers are FR Rayon.

18. The mattress as recited in claim 16, wherein at least a majority of the staple fibers are oriented within plus or minus 30 degrees of a line running perpendicular to the machine direction.

19. The mattress as recited in claim 10, wherein the elastomeric stitching yarns are wrapped yarns.

20. The mattress as recited in claim 10, wherein the gripping power zone comprises between 2 and 15 stitch lines including both the first and second plurality of elastomeric stitching yarns.

* * * * *